United States Patent [19]

Cremona

[11] 4,313,481

[45] Feb. 2, 1982

[54] LOG SHEARING DEVICE

[76] Inventor: Angelo Cremona, Viale Lombardia 275, Monza, Italy, 20052

[21] Appl. No.: 101,003

[22] Filed: Dec. 6, 1979

[30] Foreign Application Priority Data

Jul. 19, 1979 [IT] Italy ..... 24486 A/79

[51] Int. Cl.[3] ..... B27L 5/02

[52] U.S. Cl. ..... 144/209 B; 144/177

[58] Field of Search ..... 144/177, 209 R, 209 B, 144/323

[56] References Cited

U.S. PATENT DOCUMENTS

| | | | |
|---|---|---|---|
| 144,938 | 11/1873 | Williams | 144/177 |
| 2,261,497 | 11/1941 | Hill | 144/209 B |
| 2,695,044 | 11/1954 | Miller et al. | 144/209 B |
| 4,013,108 | 3/1977 | Guillerm et al. | 144/209 R X |

*Primary Examiner*—W. D. Bray

*Attorney, Agent, or Firm*—McGlew and Tuttle

[57] ABSTRACT

A device for shearing wooden logs, comprising a beam on which the log is secured and guidedly supported for rotation about an axis, a blade and a pressure bar, and adjusting means for adjustment of the variation of the radius of the curved cutting path and of thickness of the sheared sheets is disclosed.

12 Claims, 4 Drawing Figures

30
29
26
31
27
25a
25
1
5
5
4
24
23
22
22a
4
17
18
19
14
14a
20
21
61
32
60
60
62
3
16
34
35
33
24a
36
38
39
40
37
43a
44
41
42
55
43
45
46
47
48
49
51
52
54
56
50
53
X
X
42
41
37
38
36
39

LOG SHEARING DEVICE

BACKGROUND OF THE INVENTION

The present invention relates to a device for the shearing of wood logs to obtain low-thickness sheets, by means of curved cutting paths, with curvature radius fully adjustable and variable during the entire operation, in accordance with the shearing process described in co-pending U.S. patent application Ser. No. 073,112 filed on Sept. 6, 1979.

Two devices are currently used to obtain thin wood sheets, called "veneers or shearings" a reciprocating-motion plane shearer and a rotating-motion stripper.

Normally, a reciprocating-motion plane shearer is composed of a structure supporting and blocking the wooden log, and of a supporting structure for the cutting tools, i.e., the blade or cutter and a pressure bar.

Such structures have a linear reciprocating motion, relative to each other, in a direction that may be horizontal or vertical or tilted.

The so-called horizontal shearers usually include a tool-carrying device operative to reciprocate with a horizontal motion, and a log-carrying device operable to move in an intermittent, straight-line advancing motion, at right angles to the motion of the tool-carrying devices and synchronized therewith, to obtain a definite-thickness at every back-and-forth motion of the tools. Generally, in the so-called vertical shearers, the device equipped with reciprocating vertical straight-line motion is the log-carrying device, whilst the tool-carrying device shifts with an intermittent straight-line motion at right angles to the motion of the log-carrying device.

A rotating-motion stripper is normally composed of a device supporting and blocking the log, which rotates on a fixed axis and a cutting-tool supporting device, for supporting a blade and pressure bar, having a continuous radial straight-line advancement motion towards the rotation axis of the log-carrying device.

The operation by which a definite-thickness thin sheet of wood is obtained at every turn of the stripper is known as "eccentric stripping", for in such cases the log-carrying device is built in such a way that the log rotates eccentrically around the rotation axis, having contact with the cutting tools getting continuously closer to the axis itself at a speed which is proportional to the speed of rotation.

A plane shearer with reciprocating motion does not always cut the sheets on a plane, while a rotating-motion stripper cuts the sheets with continually decreasing-curvature paths according to a spiral shape whose parameters are not variable as wanted in every.

SUMMARY OF THE INVENTION

Now, in the practical aspect of shearing, the need to determine beforehand the curvature value of the cutting paths arises often, together with the need to determine beforehand the law by which the value must vary during the entire shearing process of a given log, so as to obtain more or less curved sheets and therefore optimize the result of the shearing operation from the point of view of both quantity and quality.

An object of the invention is to fulfill the above need. This invention is shown in a non-limitative example according to a preferred form of execution in the enclosed drawings.

In accordance with the invention, a device is provided for shearing a log longitudinally disposed on a fixed axis of rotation through a curved cutting path having a variable radius of curvature about the fixed axis to produce a thin sheet which includes a beam for supporting and blocking the log to be cut, slide means including elongated slides, transversely mounted relative to the fixed axis, slidably supporting and guiding the beam for linear movement relative to the fixed axis, means for rotating said slide means and said beam with the log to be cut about the fixed axis, cutting means for shearing the log to be cut mounted for rectilinear movement relative to the fixed axis, means for shifting the cutting means and the beam with the log to be cut in synchronization with the rotation of the log about the fixed axis, and means for adjusting the shifting means to adjust one of the rectilinear motion of the cutting means and the linear motion of the beam with the log to be cut, thereby variably adjusting the radius of curvature and thickness of the sheet. Ths shifting means preferably include first lead-nuts fixed to the beam, beam screws coupled to the first lead nut, the beam screws being axially fixed to and rotatably supported by the slide means, the slide means having a hollow, a shaft extending through the hollow and mounted to the slide means for rotation, and gear means rotatably connecting each of the beam screws and the shafts for rotation with relative differential angular velocities, the beam being linearly movable relative to the fixed axis responsive to the rotation of the beam screws, and wherein the rotating means includes a motor operatively connected to the slide means. The cutting means preferably includes a fixed bracing, a cutting blade, a pressure bar, a supporting beam movably mounted to the bracing and supporting the blade and bar in cutting relationship for rectilinear movement relative to the fixed axis, second lead-nuts fixed to the support beam, shearing screws coupled to the second lead-nuts, the shearing screws being rotatably supported by the bracings, and the shearing screws being operatively connected to the slide means.

BRIEF DESCRIPTION OF THE DRAWINGS

In the drawings, FIGS. 1 and 1' jointly illustrate, in a top plan view, partly in section, the whole device according to the invention, except for one of the boxes containing the shift motion control elements which is not, shown in detail for the sake of clarity.

DETAILED DESCRIPTION OF THE PREFERRED EMBODIMENT

Figure 1:
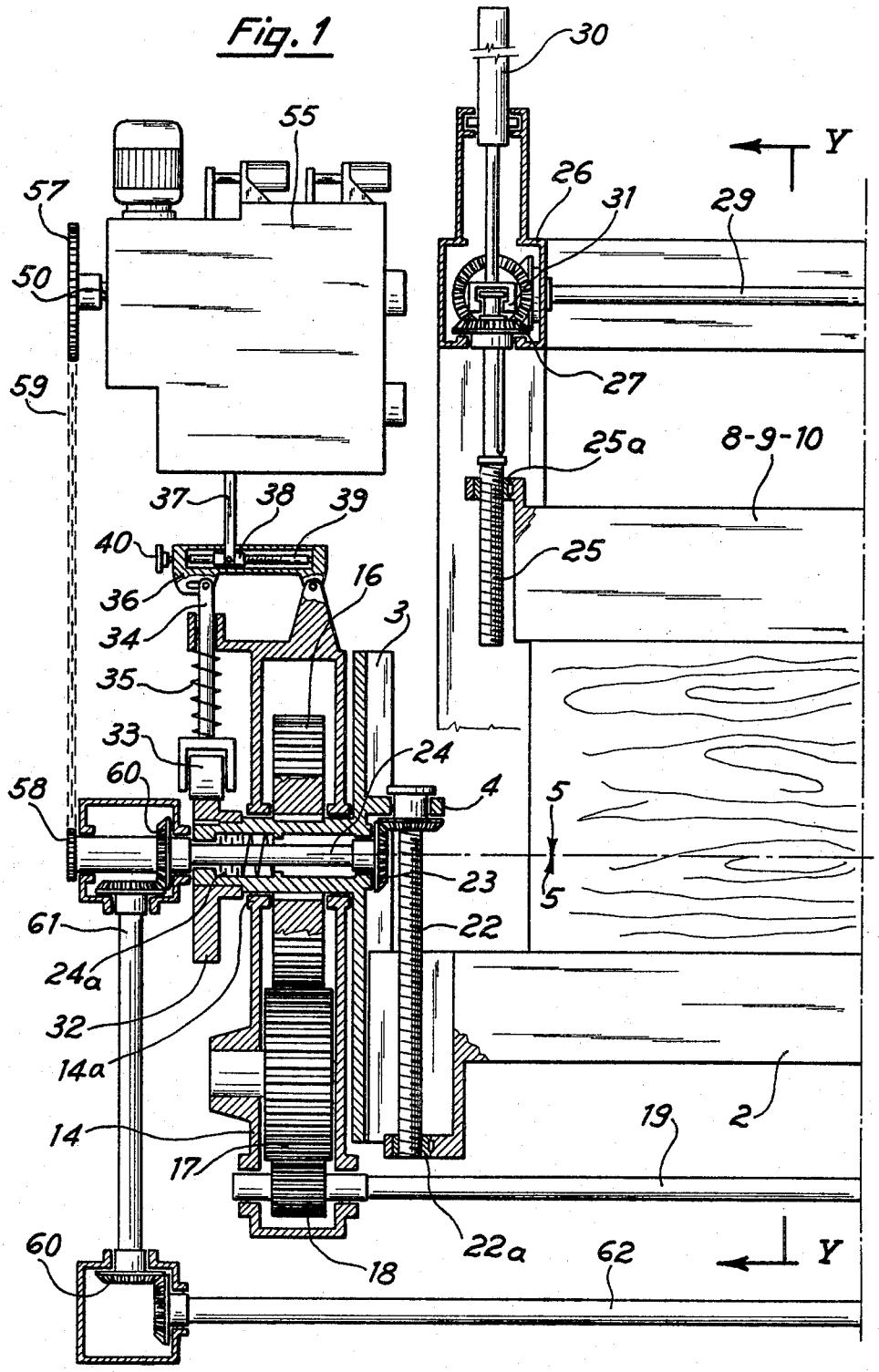
FIG. 1*a* is a section along the line X—X of FIG. 1'.
Figures 1, 1A:
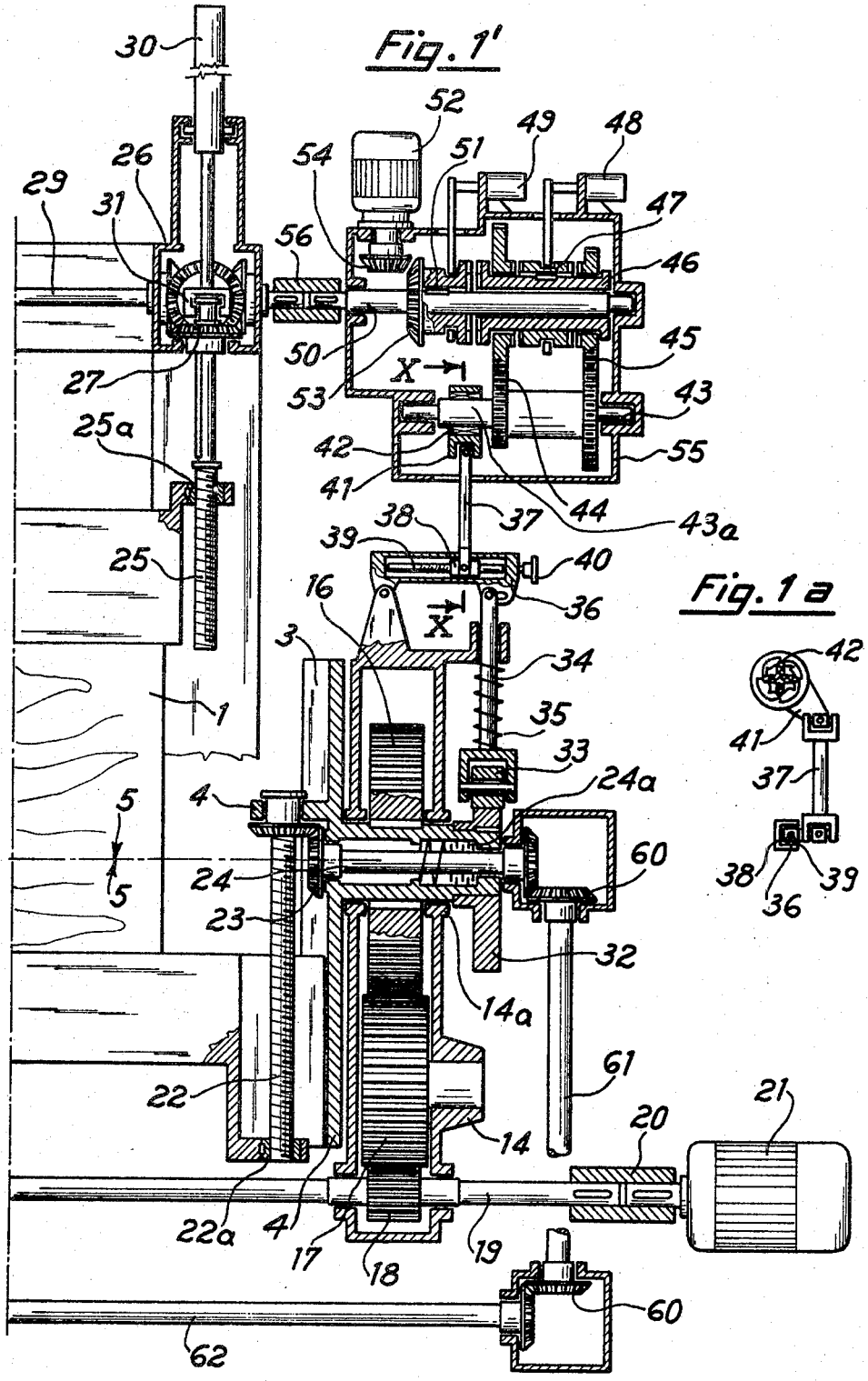

As can be seen from the drawings, the log to be sheared, shown schematically, is indicated by 1, and is supported and blocked on beam 2, which in turn is supported and guided by elongated slides 3.

Slides 3 are solid firmly connected with the mounting members 4 which are rotatable around a fixed axis 5.

Beam 2 and with it log 1, in addition to being rotatable with slides 3, at the same time, can shift relative to the axis with a transverse linear motion.

Figure 2:
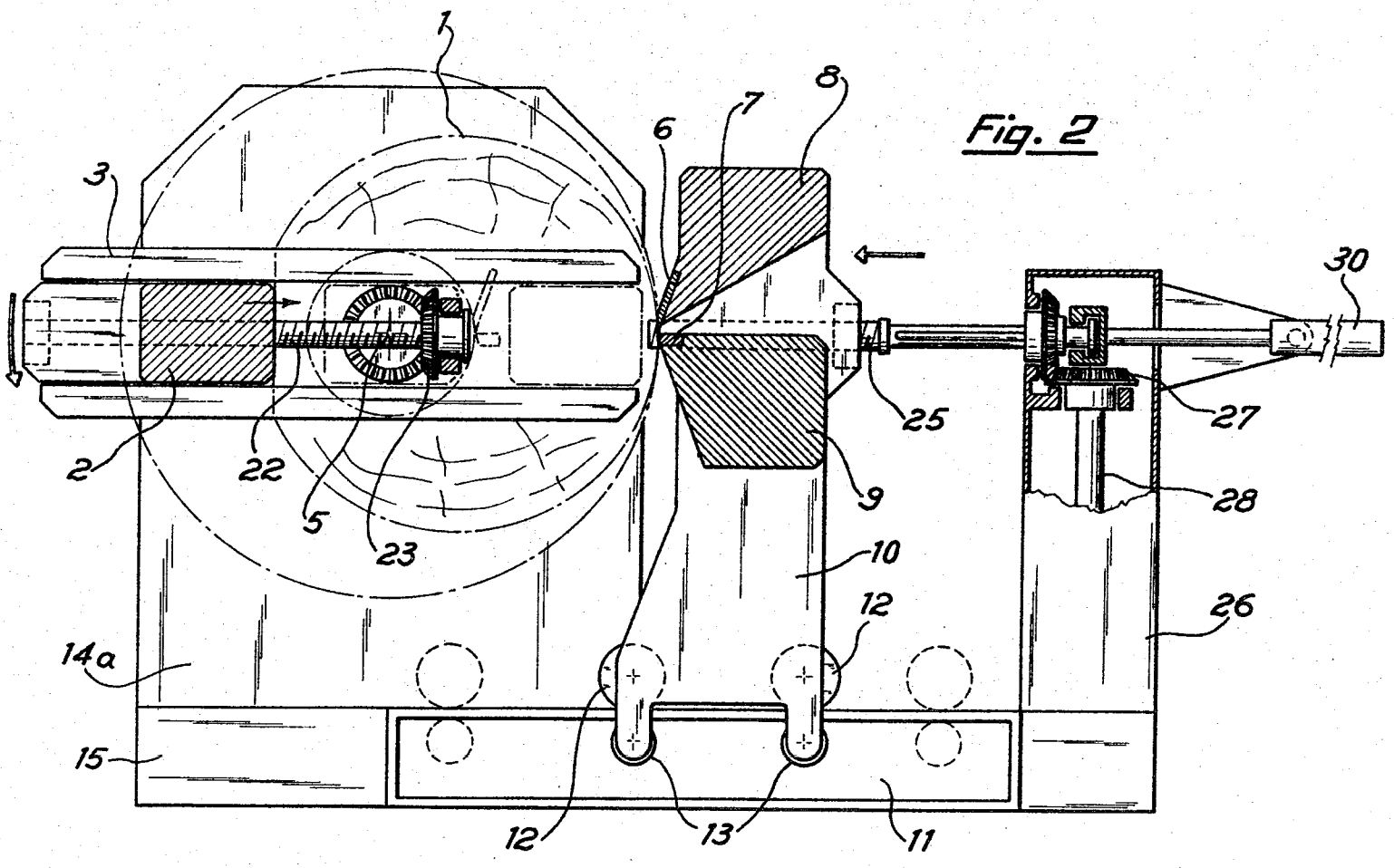
FIG. 2 is a section along line Y—Y of FIG. 1.

At the same time, a blade or cutter 6 and a pressure bar 7 (visible in FIG. 2 and hidden in FIG. 1 by the relative beams) which are supported by beams 8 and 9 respectively, can shift radially towards axis 5, by means of trolley 10, placed and guided on the rails 11 by means of wheels 12 and counterwheels 13 (see FIG. 2).

Mounting members 4 are in turn supported by supports 14 that have braces 14*a* fixed to base 15, and become rotatable by means of motor 21 through the cogs 16, 17 and 18, propeller shaft 19 and joint 20.

The operation of such elements will be evident to those skilled in the art, based on the foregoing, and can be summed up as follows. Beam 2 can shift with respect to slides 3 by means of lead nut/screw couples, for lead nuts 22*a* are integrally fixed within the beam 2 itself while screws 22 are axially fixed to the slides 3.

On the other hand, said screw 22 can rotate relative to slides 3 by means of the conical gears 23 and shafts 24, which are coaxial and internal to the shafts 4 and supported by the same.

So that beam 2 can shift relative to slides 3, it is therefore necessary and sufficient that the internal shafts 24, joined to screws 22 rotate with an angular velocity different to the velocity of external shafts 4, fixed to said slides 3.

Trolley 10, carrying beams 8 and 9, can shift on rails 11 by means of other lead nut/screw pairs 25 and 25*a*, respectively which lead nuts 25*a* are fixed to trolley 10. Screws 25 are axially fixed to rear braces 26 and can also rotate by means of bevel gears 27 and shafts 28 leading to transmission shaft 29 through other return couplings.

Screws 25 are also able to slide within their relative pinions of bevels 27, and can be pulled along back and forth by means of suitable elements 30 (in the illustration they are shown as an example as being pneumatic or hydraulic cylinders), fixed to rear braces 26 and coaxially joined with screws 25 by rotating bevels and thrust-bearing 31.

The described arrangement permits quick separation of cutting tools 6 and 7 from log 1, and a similarly quick joining thereof back to their preceding operating position with no danger of incorrect maneuvering that can result in disastrous collisions between the cutting tools and the parts rotating around axis 5.

The distance of the blade edge from the rotation axis 5 of log 1 determines the curvature radius of the cutting path of blade 6 relative to log 1.

Therefore, once the initial position of blade 6 and the ratio between the shift advancement of the blade and that of the log 1 relative to slides 3 is determined, the cutting radius value is fixed for every moment of the entire shearing operation of log 1.

The curvature radius of the cutting path will be decreasing from an initial value to a final one, both of which are fully adjustable within the maximum and minimum values permitted by the machine.

The sum of the advancements per rotation of the shift motion of blade 6 and of the shift motion of log 1 determine the thickness of the sheared sheet.

Both the above shift motions can be continuous or intermittent, but they are always synchronized to the rotation motion around axis 5. It is essential that the shift motions can be adjustable independent of each other, so that it is possible to vary as desired, both the cutting radius variation formula and the thickness of the sheared sheets.

For this purpose a special device has been provided (see FIG. 1) that has two cam wheels 32, which fit closely on the mounting members 4, on the periphery of which cam rollers 33 can roll. These rollers are pivoted on the ends of bars 34 and are urged into contact with cams 32 by springs 35.

Bars 34 are designed to act on the oscillating levers 36 which, in turn, can transmit the motion to connecting rods 37 by means of cursors 38, guided within levers 36 and shiftable along the levers by means of screws 39 and hand-wheels 40.

The connecting rods 37 can activate, through levers 41, the unidirectional joints (e.g. freewheels or equivalent ratchet gear systems), shown schematically in 42 by causing the freewheels or ratchet gear system to be operatively engaged to cogwheel parts 44,45 via a shiftable sleeve 43*a* on shaft 3.

These, in turn, act on shafts 43, which transmit rotary motion to the cogwheel pairs 44 and 45 mounted thereto. One or the other of the above pairs 44, 45 alternately, can be joined to shaft 46 by means of insertion sleeve 47, keyed thereto, which is activated by a special control device 48. This device 48 can, as an example, be composed by a hydraulic or pneumatic cylinder having effect on sleeve 47 by means of a Y-shaped lever. A similar control device 49 joins the exit shaft 50, which is, in part, coaxially received within shaft 46 to shaft 46 itself, and by means of conical wheel 53, fixed to shaft 50 by key 51, joins shaft 50 to the shaft of motor 52 via conical wheel 54. Identical or similar groups of elements 41 to 54 are enclosed in the drawing within control housings boxes 55.

One of these groups is joined, by means of coupling 56, to transmission shaft 29, which activates screws 25. The other group is joined, by means of shift cogwheels 57 and 58 and transmission chain 59, to shafts 24, which activate screws 22. Screws 22 are coupled to each other, so that they rotate together, by means of return bevel gears 60 and transmission shafts 61 and 62. During the log shearing operation, shafts 46 and 50 are joined to each other and shafts 46 are also joined to one of the pairs of cogwheels 44 or 45. Initially, the cogwheel pair 44 or 45 is engaged, transmitting the greatest rotation to shafts 46, so that the log is cut with greater thickness in the initial phase of shaping (rounding) phase and substantially, the other pair of cogwheels is engaged, so that a series of uniform-characteristics sheets of required thickness is obtained. When log 1, rotating on axis 5, turns through a part of a full rotation (e.g. half a rotation) during which it is in contact with cutting tools 6 and 7, that is to say during the cutting phase, rollers 33 roll on a part of the profile of the periphery of cams 32 shaped so that it causes and maintains the disengagement of joints 42.

In this phase, therefore, the one of the two shafts 43 that is joined to screws 25 is stationary, whilst the one of the two shafts 43 that is joined to screws 22 is forced to rotate synchronously by mounting members 44 shafts 4 and shafts 24. Shafts 4 and 24 are, in fact, connected to each other by a friction device shown schematically in 24*a*, while the unidirectional joint 42 is not engaged for in this case the elements between the joint 42 and rollers 33 are static and all resistance to motion in the elements moved by internal shafts 24 is eliminated. Friction device 24*a* is capable of transmitting torque sufficient to rotate all elements placed between the two shafts 24 and between shafts 24 and engaged shaft 43, and therefore screws 22 do not rotate on their axis just like screws 25 and do not therefore transmit shift motions.

When log 1, rotating on axis 5, turns through the following remaining part of a full rotation, in which it does not come into contact with tools 6 and 7, cams 32 move the elements 33 to 41, so that the levers 41 rotate and, by means of the automatic insertion of inserts 42, shafts 43 are activated, and therefore activate through the kinematic chain described above in connection with screws 22 and 25, overcoming the resistance of the abovementioned friction systems 24*a*.

During this phase, screws 22 and 25 rotate on their axis through such an angle that the sum of the corresponding shift advancement of beam 2 carrying log 1 and of the corresponding shift advancement of beams 8 and 9 carrying, respectively, blade 6 and pressure bar 7 defines the thickness of the sheet that will be cut during the following half-turn.

Also, as has been previously expressed, the ratio between the advancement of beams 8 and 9 and that of beam 2 defines the variation of the cutting radius during the entire shearing operation.

To adjust the value of this ratio, it is necessary to use the handwheels 40 to vary, by means of screws 39, the position of cursors 38 along lever 36.

The greater the distance of cursor 38 from the fulcrum of lever 36, the greater the amplitude of the intermittent shift advancement motion caused by the movement of the same lever 36.

Motors 52 are in fact joined to respective exit shafts 50 by means of the abovementioned control devices 49 during the phase of rapid positioning of log 1 and of the cutting tools 6 and 7, at the beginning and the end of the shearing operation, while the same motors are inactive during the true shearing phase described above, for in this case exit shafts 50 from boxes 55 are connected to other shafts 46. It is obvious that what has been hitherto described, and illustrated in the enclosed drawings, and as any person competent in the field can easily understand, is only a preferred form of execution, to which several variations can be made without going beyond the limits of the invention which, on the contrary, comprises them all.

So as an example, instead of a mechanical device for control and adjustment of the shift motions of log and cutting tools working intermittently, one could have an electronic device activating and adjusting continuously the above motions, by means of, e.g., a pair of suitable motors working in direct current and equipped with relative electronic devices.

I claim:

1. A device for shearing a log longitudinally disposed on a fixed axis of rotation through a curved cutting path having a variable radius of curvature about the fixed axis to produce a thin sheet comprising, a beam for supporting and blocking the log to be cut, slide means including elongated slides, transversely mounted relative to the fixed axis, slidably supporting and guiding said beam for linear movement relative to the fixed axis, means for rotating said slide means and said beam with the log to be cut about the fixed axis, cutting means for shearing the log to be cut mounted for rectilinear movement relative to the fixed axis, means for shifting said cutting means and said beam with the log to be cut in synchronization with the rotation of said log about the fixed axis, and means for adjusting said shifting means to adjust one of the rectilinear motion of said cutting means and the linear motion of said beam with the log to be cut thereby variably adjusting the radius of curvature and thickness of the sheet.

2. A device as set forth in claim 1 wherein said shifting means includes first lead-nuts fixed to said beam, beam screws coupled to said first lead-nuts, said beam screws being axially fixed to and rotatably supported by said slide means, said slide means having a hollow, a shaft extending through said hollow and mounted to said slide means for rotation, and gear means rotatably connecting each of said beam screws and said shafts for rotation with relative differential angular velocities, said beam being linearly moveable relative to the fixed axis responsive to the rotation of said beam screws, and wherein said rotating means comprises a motor operatively connected to said slide means.

3. A device as set forth in claim 2 wherein said cutting means includes a fixed bracing, a cutting blade, a pressure bar, a supporting beam movably mounted to said bracing and supporting said blade and bar in cutting relationship for rectilinear movement relative to the fixed axis, second lead-nuts fixed to said support beam, shearing screws coupled to said second lead-nuts, said shearing screws being rotatably supported by said bracings and said shearing screws being operatively connected to said slide means.

4. A device as set forth in claim 3, wherein said cutting means includes means mounted to said bracing for axially moving said shearing screws into and out of engagement with the log to be cut.

5. A device as set forth in claims 3 or 4, wherein said shifting means is operative to intermittently an independently adjust the motions of said cutting means and said beam with the log to be cut, said shifting means including cam wheels fixedly mounted to said slide means for rotation therewith, cam means resiliently engaging said cam wheels for following the profile of said cam wheels, a first shift connection means connecting said cam means to said beam screws and a second shift connection means connecting said cam means to said shearing screws, said adjusting means including follow levers operatively connecting said each of said shift connection means and said cam means.

6. A device as set forth in claim 5, further comprising a cursor screw housed in each of said follower levers, a cursor adjustably mounted to said cursor screw, and a handle wheel mounted to said follower lever in connection with said cursor screw for rotating said cursor screw to translate said cursor on said cursor screw, and a connecting lever connecting said cursor to said shift connection means at a position dependent upon the location of said cursor on said cursor screw.

7. A device as set forth in claim 6, wherein each of said first and second shift connection means includes a control housing, a first rotary shaft rotatably mounted within said housing, first and second cogwheels mounted to said rotary shaft at axially spaced locations, rachet means connectable between said first rotary shaft and said connecting lever for the unidirectional transmission of motion to said first rotary shaft from said cam means, a second rotary shaft mounted to said housing for rotation, first control means for alternately connecting said second rotary shaft to one of said first and second cogwheels for rotation with said first rotary shaft, an exit shaft rotatably received in said second rotary shaft, and second control means for selectively engaging said exit shaft with said second rotary shaft for rotation, and said beam screws being operatively connected to said exit shaft of said first shift connection means, and said shearing screws being operatively connected to said exit shaft of said second shift connection means.

8. A device as set forth in claim 7, wherein each of said first and second shaft connection means includes motor means operable to drive said exit shaft, and wherein said second control means is operative for selectively coupling said exit shaft to said motor means.

9. A device as set forth in claim 8, further comprising a transmission shaft coupled to said exit shaft of said second shift connection means, and gears on said transmission shaft engaging each of said shearing screws, and a first shift cogwheel mounted to said exit shaft of said first shift connection means, a second shift cogwheel mounted to one of said shafts of said slide means hollow, a transmission chain operatively connecting said first and second shift cogwheels, and transmission means coupling each of said shafts of said slide means hollow so that said shafts rotate together.

10. A device as set forth in claim 2 or 3 or 4 further comprising means in said hollow for frictionally connecting said shaft in said hollow to said slide means for selective rotation.

11. A device as set forth in claim 5 further comprising means in said hollow for frictionally connecting said shaft in said hollow to said slide means for selective rotation.

12. A device as set forth in claim 7 further comprising means in said hollow for frictionally connecting said shaft in said hollow to said slide means for rotation when said rachet means responsive to the action of said cam means over a portion of the periphery of said cam wheel does not rotate said first rotary shaft of said second shift transmission means.

* * * * *